US006997760B2

(12) United States Patent
Tsai

(10) Patent No.: US 6,997,760 B2
(45) Date of Patent: Feb. 14, 2006

(54) TERMINAL STRUCTURE OF AN ELECTRICAL CONNECTOR HAVING TWO HORIZONTAL CONTACT SURFACES OPPOSITE TO EACH OTHER

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/792,225

(22) Filed: Mar. 2, 2004

(65) Prior Publication Data

US 2004/0175995 A1 Sep. 9, 2004

(30) Foreign Application Priority Data

Mar. 5, 2003 (TW) ..... 92203378 U

(51) Int. Cl.
*H01R 11/22* (2006.01)

(52) U.S. Cl. ..... 439/856

(58) Field of Classification Search ..... 439/856, 439/876

See application file for complete search history.

(56) References Cited

U.S. PATENT DOCUMENTS 3,910,663 A * 10/1975 Winger ..... 439/92
5,009,618 A * 4/1991 Black et al. ..... 439/736
6,790,102 B2 * 9/2004 Stillabower et al. ..... 439/856

* cited by examiner

*Primary Examiner*—Khiem Nguyen
(74) *Attorney, Agent, or Firm*—Pro-Techtor Int'l Services

(57) ABSTRACT

A terminal structure of an electrical connector has continuous terminals and a connection material tape with projections reapectively connected to the continuous terminals, which are formed by pressing a metal plate. Each terminal includes an extension having a first end and a second end, a connection having a first end connected to the first end of the extension and a second end formed with a to-be-broken portion connected to the projection, and a contact connected to the second end of the extension. The to-be-broken portion is broken to separate the terminal from the material tape. The contact has two elastic arms with a gap therebetween, and the two elastic arms have contact surfaces close to each other. The extension is horizontal and has a twisted portion to make the contact vertical so that the two contact surfaces of the contact may contact an inserted male terminal in vertical directions.

8 Claims, 6 Drawing Sheets

TERMINAL STRUCTURE OF AN ELECTRICAL CONNECTOR HAVING TWO HORIZONTAL CONTACT SURFACES OPPOSITE TO EACH OTHER

BACKGROUND OF THE INVENTION

1. Field of the Invention

The invention relates to a terminal structure, and more particularly to a terminal structure of an electrical connector having two horizontal contact surfaces opposite to each other.

2. Description of the Related Art

Referring to FIG. 1, a conventional terminal structure of an electrical connector includes an extension 11, a connection 12, and a contact 13, wherein the plate surfaces of the extension 11 and the connection 12 are in the same vertical plane. The contact 13 has two elastic arms 14 opposite to each other with a gap therebetween. The two elastic arms 14 have contact surfaces 15 close to each other. In addition, the two elastic arms 14 further have two twisted portions 16 to make the plate surfaces of the two elastic arms 14 opposite to each other.

The two elastic arms 14 of the conventional structure have twisted portions 16, respectively, to make the plate surfaces of the two elastic arms 14 opposite to each other so that wider plate surfaces may be utilized to form the contact surfaces 15. Instead of side surfaces 19 of a male terminal 17, the two contact surfaces 15 may contact top and bottom surfaces 18 of the inserted male terminal 17. Because the side surfaces 19 of the male terminal 17 are the cut-off surfaces that are rougher and the top and bottom surfaces are the smooth metal plate surfaces, it is preferred to contact the top and bottom surfaces in order to protect the gold-plated layers of the contact surfaces 15.

Although the prior art structure has the above-mentioned advantage, the following drawbacks will be caused.

1. The plate surfaces of the extension 11 and connection 12 are the vertical surfaces, a row of continuous terminals with gaps cannot be manufactured.

2. Because the two elastic arms 14 are twisted to make the plate surfaces thereof opposite to each other, it is labor-consuming and difficult to control the precision of the twisted elastic arms. Thus, the two elastic arms may be slanted, and the gap between the contact surfaces is too small or too large to cause normal contacts with the inserted terminals.

As shown in FIG. 2, the two elastic arms are slanted, wherein the phantom line represents the hole 20 on the connector. In this case, the male terminal 17 can only be in point-contact with the contact surfaces 15 but not in normal surface-contact with the contact surfaces 15. As shown in FIG. 3, the gap between the contact surfaces of the two elastic arms is too large, and the male terminal 17 cannot be in contact with the contact surfaces 15. As shown in FIG. 4, the gap between the contact surfaces of the two elastic arms is too small, and the male terminal 17 cannot be easily inserted.

Referring to FIG. 5, another conventional terminal structure of an electrical connector includes an extension 21, a connection 22, and a contact 23. The plate surface of the extension 21 is a horizontal surface and the plate surface of the connection 22 is a vertical surface. The contact 23 has two elastic arms 24 with a gap therebetween. The two elastic arms 24 have contact surfaces 25 close to each other. In addition, the two elastic arms 24 have twisted portions 26, respectively, to make the plate surfaces of the elastic arms 24 opposite to each other.

Although the above-mentioned terminal structure may be utilized to form continuous terminals with gaps and facilitate the assembly, it also has the following drawbacks.

1. Because the contact surfaces 25 of the two elastic arms 24 are vertical surfaces, they are in contact with the rough side surfaces 19 of the inserted male terminal 17, and the gold-plated layers of the contact surfaces 25 tends to be scratched.

2. Because the two elastic arms 24 are respectively twisted to make the plate surfaces opposite to each other, it is labor-consuming and the precision of the two twisted elastic arms cannot be easily controlled.

SUMMARY OF THE INVENTION

It is therefore an object of the invention to provide a terminal structure of an electrical connector, which has two horizontal contact surfaces opposite to each other and may be adapted to form continuous terminals.

Another object of the invention is to provide a terminal structure of an electrical connector, which may be easily manufactured.

The invention achieves the above-identified objects by providing a terminal structure of an electrical connector having continuous terminals and a connection material tape with projections respectively connected to the continuous terminals, which are formed by pressing a metal plate. Each terminal includes an extension having a first end and a second end, a connection having a first end connected to the first end of the extension and a second end formed with a to-be-broken portion connected to the projection, and a contact connected to the second end of the extension. The to-be-broken portion is broken to separate the terminal from the material tape. The contact has two elastic arms with a gap therebetween, and the two elastic arms have contact surfaces close to each other. The extension is horizontal and has a twisted portion to make the contact vertical so that the two contact surfaces of the contact may contact an inserted male terminal in vertical directions.

According to the above-mentioned structure, when the terminal is in contact with the male terminal, the two contact surfaces may contact the top and bottom surfaces (smooth surfaces) of the male terminal but not the rough side surfaces because the contact surfaces of the contact are moved in the vertical directions.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
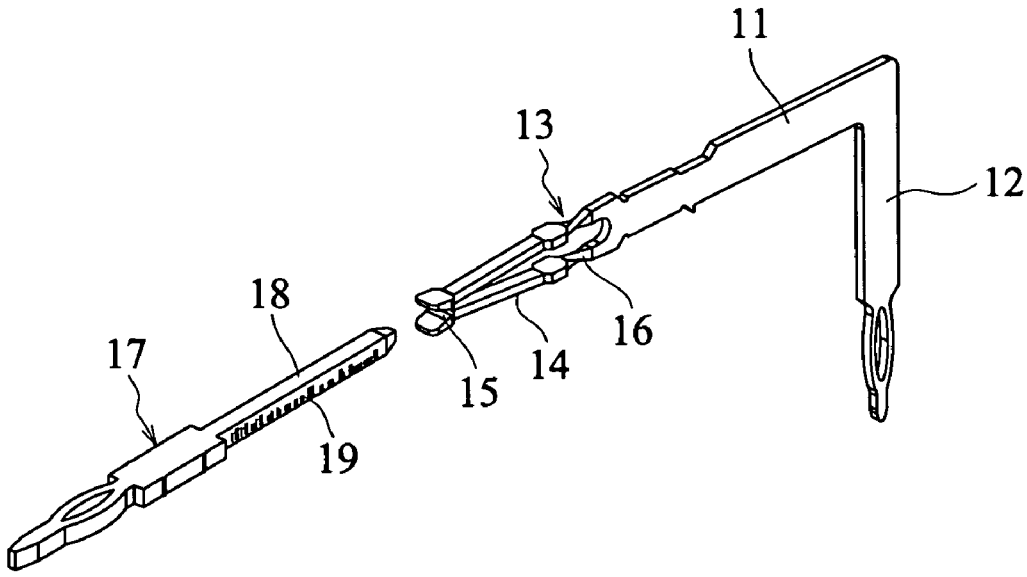
FIG. 1 (Prior Art)
FIG. 1 is a pictorial view showing a conventional terminal structure of an electrical connector.
Figure 5:
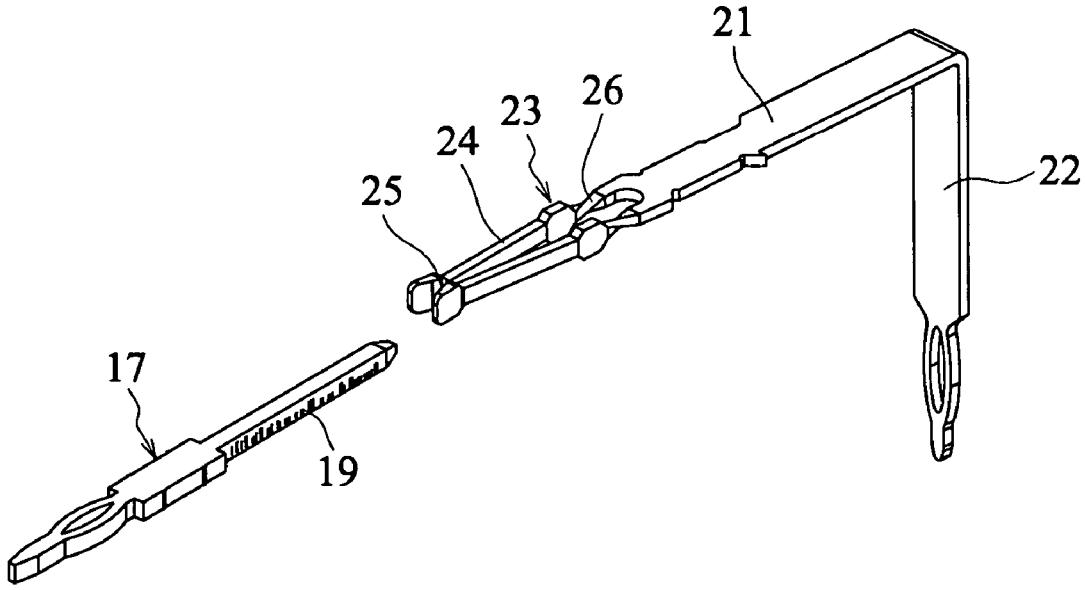
FIG. 5 (Prior Art)
FIG. 5 is a pictorial view showing another terminal structure of an electrical connector.
Figure 2:
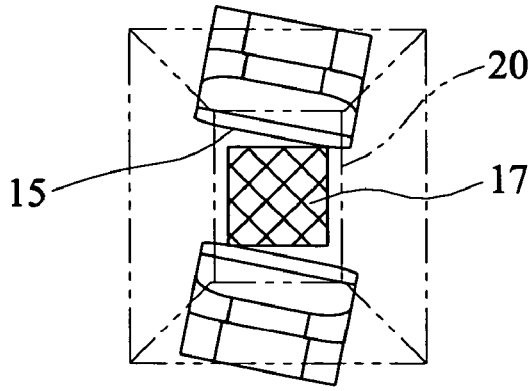
FIG. 2 (Prior Art)
FIG. 2 is a schematic illustration showing one state of the conventional terminal structure of the electrical connector.
Figure 3:
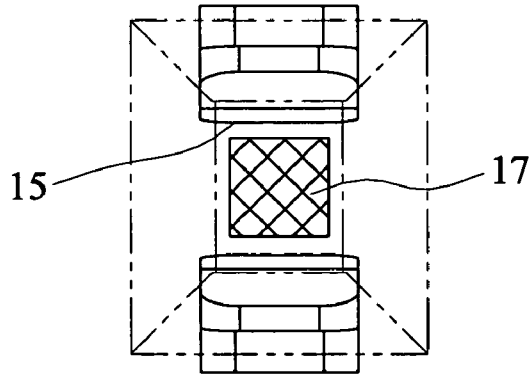
FIG. 3 (Prior Art)
FIG. 3 is a schematic illustration showing another state of the conventional terminal structure of the electrical connector.
Figure 4:
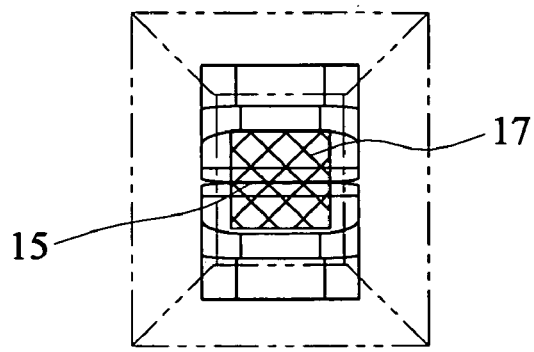
FIG. 4 (Prior Art)
FIG. 4 is a schematic illustration showing still another state of the conventional terminal structure of the electrical connector.
Figure 6:
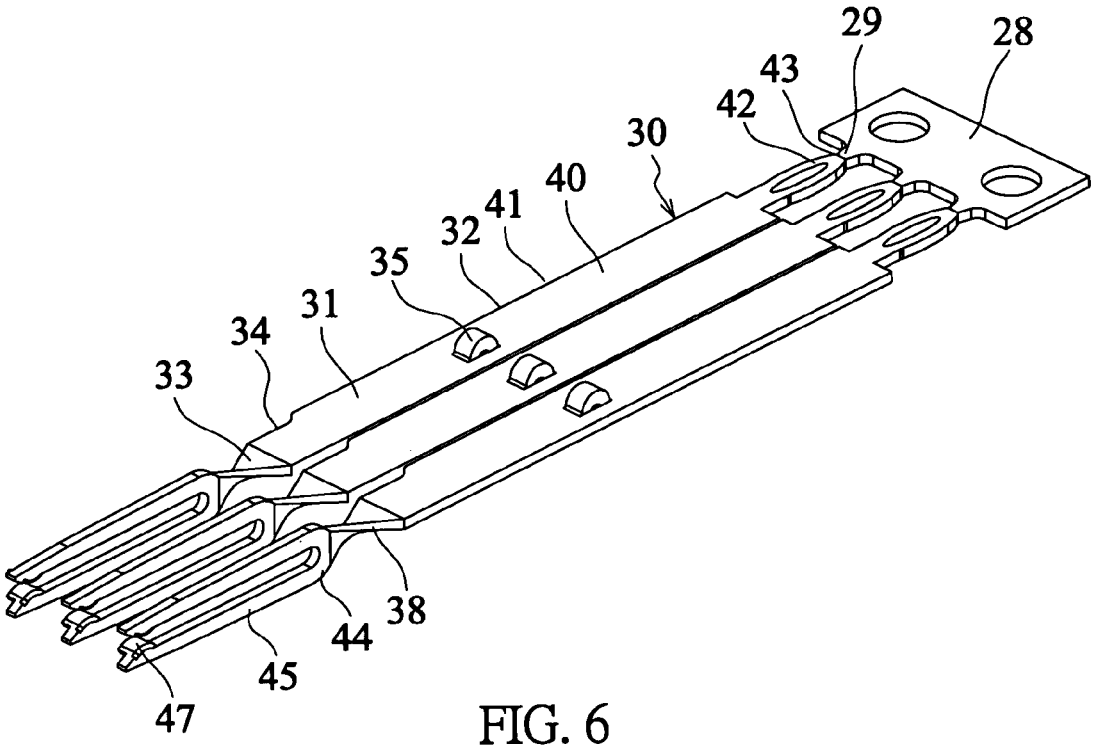
FIG. 6 is a pictorial view showing continuous terminals, which are not bent yet, according to a first embodiment of the invention.
Figure 7:
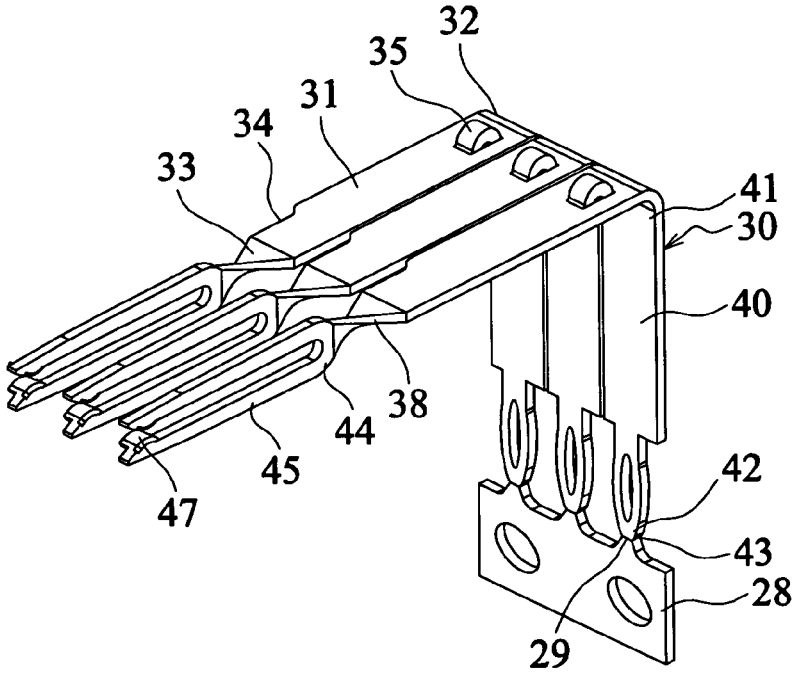
FIG. 7 is a pictorial view showing continuous terminals, which have been bent, according to the first embodiment of the invention.

Referring to FIGS. 6 and 7, a terminal structure of the invention has continuous terminals 30 and a connection material tape 28 with projections 29 respectively connected to the continuous terminals 30, which are formed by pressing a metal plate. Each terminal 30 includes an extension 31, a connection 40, a contact 44 and a twisted portion 38.

The extension 31 is a horizontal plate having a first end 32, a second end 33, a plate-surface reducing portion 34 shrunk toward the second end 33, and a projection 35 projecting over the plate surface.

The connection 40 having a first end 41 connected to the first end 32 of the extension 31, and a second end 42 formed with a to-be-broken portion 43 connected to the porjection 29 of the connection material tape 28, wherein the connection 40 is bent to form an angle of 90 degrees with the extension 31. The to-be-broken portion 43 is broken to separate the terminal 30 from the connection material tape 28 and is formed with a cutting mark to facilitate separating the terminal 30 from the connection material tape 28.

Figure 8:
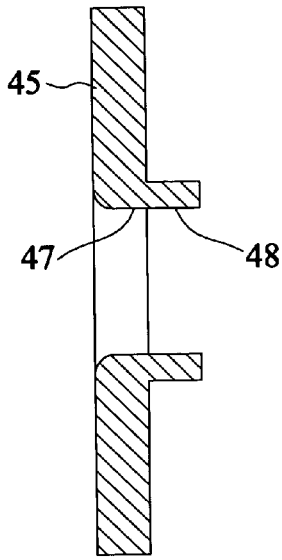
FIG. 8 is a cross-sectional view showing contact surfaces of the first embodiment of the invention.

The contact 44 is connected to the second end 33 of the extension 31. The contact 44 has two elastic arms 45 with a gap therebetween, wherein the elastic arms 45 and the gap are formed by pressing the metal plate. The two elastic arms 45 have horizontal contact surfaces 47 close to each other. As shown in FIG. 8, the contact surface 47 includes a flange 48, which is formed by extruding a portion of the metal plate toward a side to reduce the plate thickness.

The twisted portion 38 is formed at the second end 33 of the extension 31 to make the contact 44 vertical and enable the two contact surfaces 47 of the contact 44 to contact an inserted male terminal in vertical directions.

Because the twisted portion 38 is positioned on the plate-surface reducing portion 34 of the extension, the contact 44 after being twisted is biased toward a side of the extension 31. Because the contact surface 47 of the contact 44 is formed with the flange 48 toward the other side of the extension 31, the contact surface 47 may correspond to the extension 31 and is located at the center.

Figure 9:
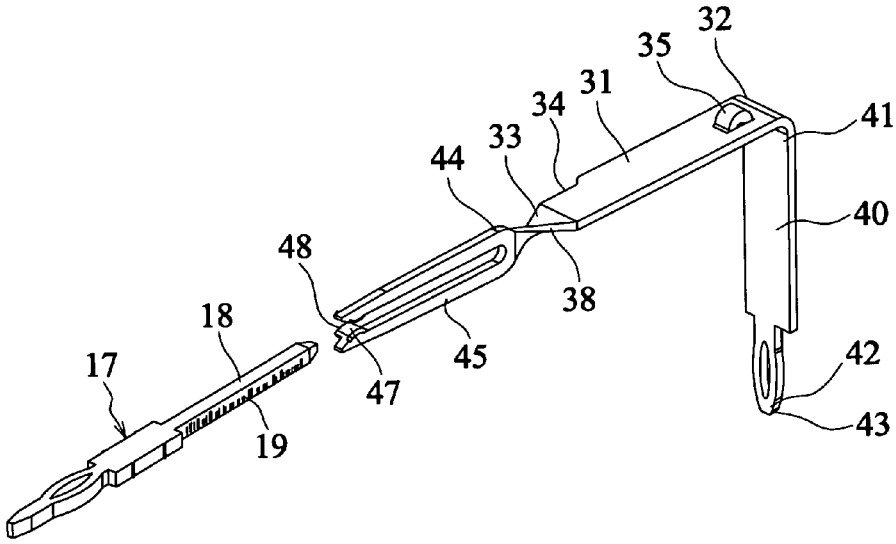
FIG. 9 is a pictorial view showing the state of the first embodiment of the invention.

As shown in FIG. 9, when the male terminal 17 is connected to the terminal structure, the contact surfaces 47 (but not the two side surfaces 19) are in contact with the top and bottom surfaces 18 of the male terminal 17 because the contact surfaces 47 of the contact 44 may contact the male terminal 17 in vertical directions.

The terminal structure of the invention has the following advantages

1. The continuous terminals may be easily formed and manufactured according to the terminal structure.

2. The gold-plated layers of the contact surfaces of the male terminal 17 are not scratched or damaged because the two contact surfaces 47 are in contact with the top and bottom surfaces 18, which are smooth surfaces, of the male terminal 17.

3. Because the twisted portion 38 is formed on the extension 31 and the elastic arms 45 are not twisted, the gap between the two contact surfaces 47 is not influenced. In addition, the gap between the two contact surfaces 47 are directly formed by way of pressing, and the precision may be easily controlled.

4. Because the contact surface 47 includes the flange 48, which is formed by extruding a portion of the metal plate toward a side to reduce the plate thickness, the area of the contact surface is wider and the contact surface 47 is a smooth surface but not a rough cut-off surface as the contact surface 47 is formed by extrusion.

Figure 10:
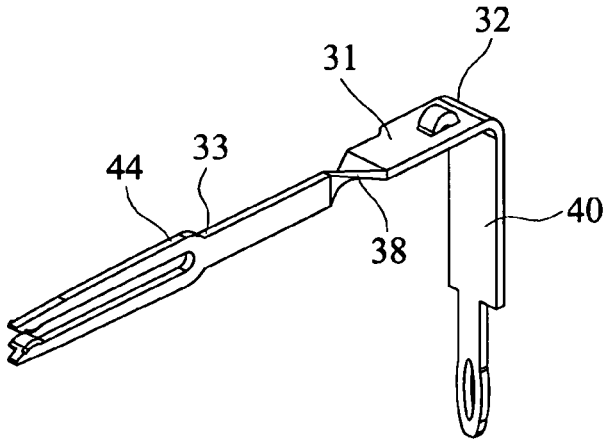
FIG. 10 is a pictorial view showing a second embodiment of the invention.

As shown in FIG. 10, the second embodiment of the invention is almost the same as that of the first embodiment except for the difference that the twisted portion 38 is formed at a middle of the extension 31.

Figure 11:
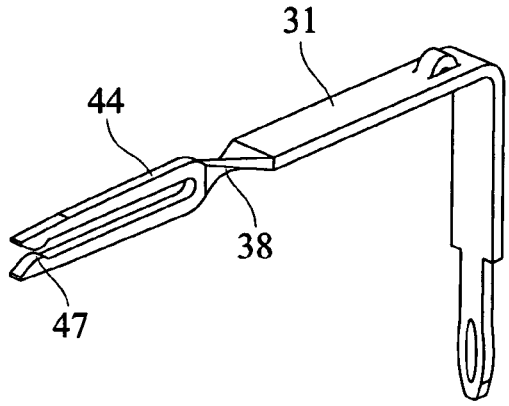
FIG. 11 is a pictorial view showing a third embodiment of the invention.

As shown in FIG. 11, the third embodiment of the invention is almost the same as that of the first embodiment except for the difference that the contact surface 47 of the contact 44 does not have the flange protruding over the plate surface. Because the contact surface 47 does not protrude over a side of the extension 31, the extension 31 of this embodiment need not have a plate-surface reducing portion shrunk toward a side. However, in order to form the sufficient contact surface 47, a thicker metal plate has to be used.

Figure 12:
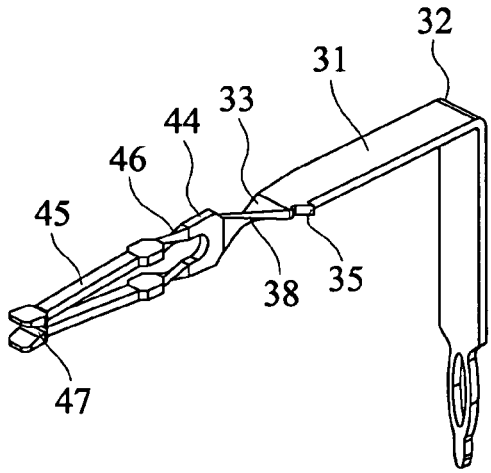
FIG. 12 is a pictorial view showing a fourth embodiment of the invention.

As shown in FIG. 12, the fourth embodiment of the invention is almost the same as that of the first embodiment because the second end 33 of the extension 31 has the twisted portion 38 to make the contact 44 vertical and enable the contact surfaces 47 of the contact to contact the inserted male terminal in the vertical directions. The difference therebetween is that each of the elastic arms 45 of the contact 44 has a second twisted portion 46 to make the plate surfaces of the elastic arms 45 opposite to each other in the vertical directions. Thus, the contact surface 47 may have a larger contact surface area. In addition, the extension 31 has a projection 35 projecting over a side thereof.

Figure 13:
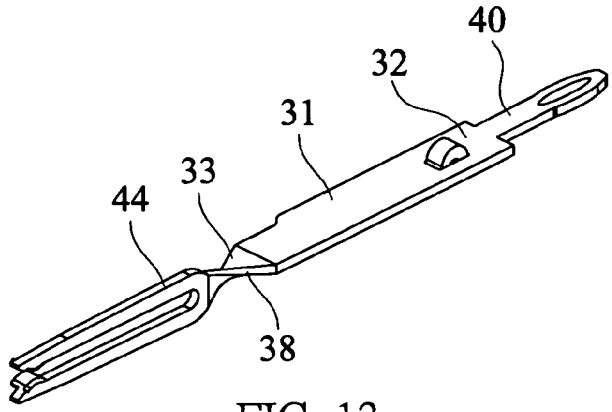
FIG. 13 is a pictorial view showing a fifth embodiment of the invention.

As shown in FIG. 13, the fifth embodiment of the invention is almost the same as that of the first embodiment because the second end 33 of the extension 31 is formed with the twisted portion 38 to make the contact 44 vertical, except for the difference that the angle between the connection 40 and the extension 31 is 180 degrees.

Figure 14:
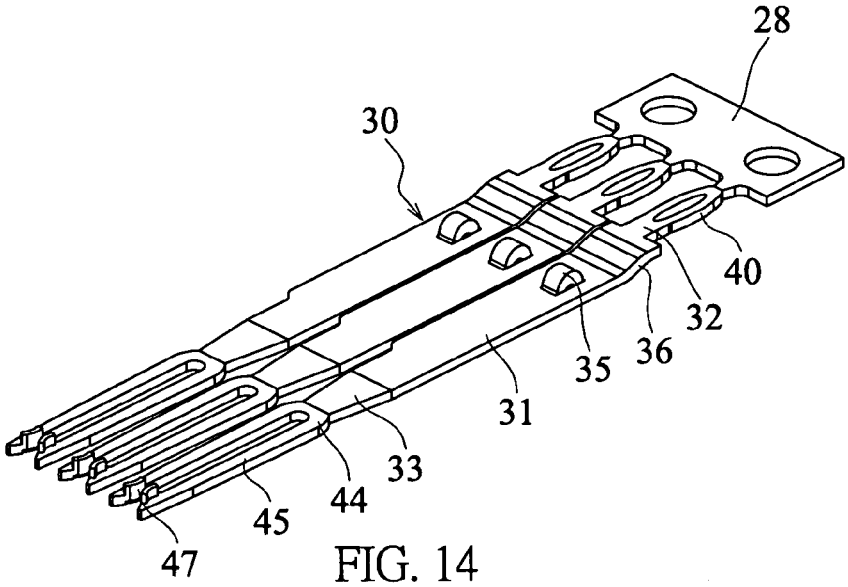
FIG. 14 is a pictorial view showing continuous terminals, which are not twisted yet, according to a sixth embodiment of the invention.
Figure 15:
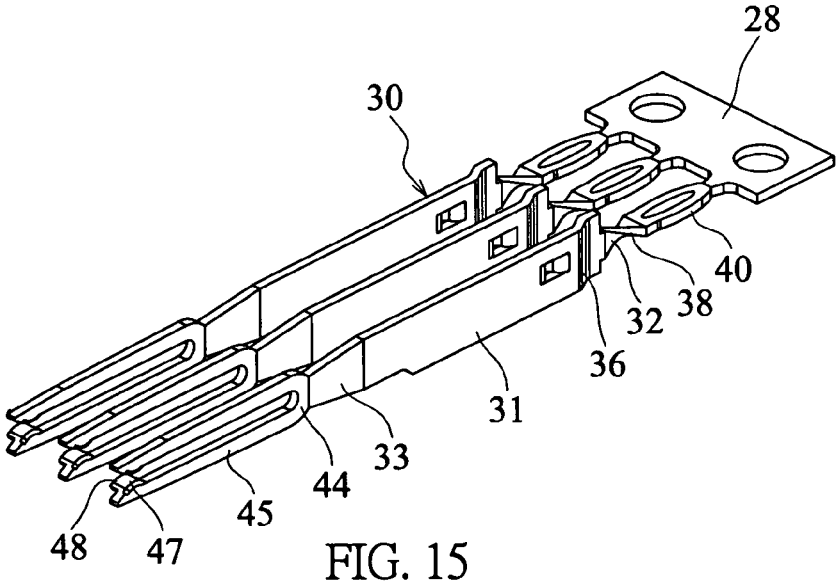
FIG. 15 is a pictorial view showing continuous terminals, which have been twisted, according to the sixth embodiment of the invention.

Referring to FIGS. 14 and 15, the terminal structure of the sixth embodiment of the invention includes continuous terminals 30 and a connection material tape 28 formed by pressing a metal plate. Each terminal 30 includes an extension 31, a connection 40, a contact 44 and a twisted portion 38.

The extension 31 has a first end 32, a second end 33, a projection 35 projecting over the plate surface thereof, and a bent portion 36 close to the first end 32.

The connection 40 parallel to the extension 31 has a first end connected to the first end 32 of the extension 31 and a second end connected to the connection material tape 28.

The contact 44 is connected to the second end 33 of the extension 31. The contact 44 has two elastic arms 45 with a gap therebetween, wherein the elastic arms 45 and the gap are formed by directly pressing the metal plate. The two elastic arms 45 have contact surfaces 47 close to each other. The contact surface 47 includes a flange 48, which is formed by extruding a portion of the metal plate toward a side to reduce the plate thickness.

The twisted portion 38 is formed at the first end 32 of the extension 31 to make the extension 31 of the contact 44 vertical and enable the two contact surfaces 47 of the contact 44 to contact an inserted male terminal in vertical directions. Because the extension 31 has the bent portion 36, the contact 44 after being twisted is vertical and slightly biased toward a side of the extension 31. Because the contact surface 47 of the contact 44 is formed with the flange toward the other side of the extension 31, the contact surface 47 may correspond to the extension 31 and is located at the center.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A terminal structure of an electrical connector, the terminal structure having continuous terminals and a connection material tape with projections respectively connected to the continuous terminals, which are formed by pressing a metal plate, each of the terminals comprising:

an extension having a first end and a second end;

a connection having a first end connected to the first end of the extension, and a second end formed with a to-be-broken portion connected to the projection of the connection material tape, wherein the to-be-broken portion is broken to separate the terminal from the connection material tape; and a contact connected to the second end of the extension, wherein the contact has two elastic arms with a gap therebetween, and the two elastic arms have contact surfaces close to each other, wherein the extension is horizontal and has a twisted portion to make the contact vertical so that the two contact surfaces of the contact may contact an inserted male terminal in vertical directions.

2. The terminal structure according to claim 1, wherein each of the contact surfaces of the contact has a flange protruding over the metal plate.

3. The terminal structure according to claim 2, wherein the extension has a horizontal plate surface, which has a plate-surface reducing portion shrunk toward the second end, and the twisted portion is formed on the plate-surface reducing portion.

4. The terminal structure according to claim 1, wherein each of the contact surfaces of the contact comprises a flange, which is formed by extruding a portion of the metal plate toward a side to reduce a plate thickness.

5. The terminal structure according to claim 1, wherein the extension has a projection projecting over a plate surface thereof.

6. The terminal structure according to claim 1, wherein the twisted portion is formed at the second end of the extension.

7. The terminal structure according to claim 1, wherein the twisted portion is formed at the first end of the extension.

8. The terminal structure according to claim 1, wherein the to-be-broken portion is formed with a cutting mark to facilitate separating the terminal from the connection material tape.

* * * * *